US007731894B2

(12) United States Patent
Pflaumer et al.

(10) Patent No.: US 7,731,894 B2
(45) Date of Patent: Jun. 8, 2010

(54) PROCESS FOR PRODUCING A BREECH SLIDE FOR A FIREARM

(75) Inventors: Wulf-Heinz Pflaumer, Arnsberg (DE); Franz Wonisch, Arnsberg (DE); Daniel Rieger, Willingen (DE)

(73) Assignee: Umarex Sportwaffen GmbH & Co. KG, Arnsberg (DE)

( * ) Notice: Subject to any disclaimer, the term of this patent is extended or adjusted under 35 U.S.C. 154(b) by 739 days.

(21) Appl. No.: 11/409,923

(22) Filed: Apr. 24, 2006

(65) Prior Publication Data

US 2007/0084040 A1 Apr. 19, 2007

(30) Foreign Application Priority Data

Apr. 26, 2005 (DE) ..... 10 2005 019 630

(51) Int. Cl.
*B22F 3/15* (2006.01)

(52) U.S. Cl. ..... 419/36

(58) Field of Classification Search ..... 419/36
See application file for complete search history.

(56) References Cited

U.S. PATENT DOCUMENTS

| | | | | |
|---|---|---|---|---|
| 5,340,510 | A * | 8/1994 | Bowen | 264/434 |
| 5,366,688 | A | 11/1994 | Terpstra et al. | |
| 5,482,671 | A | 1/1996 | Weber | |
| 5,717,156 | A * | 2/1998 | Lenkarski | 89/196 |
| 5,734,120 | A * | 3/1998 | Besselink | 89/163 |
| 5,993,507 | A | 11/1999 | Baum et al. | |
| 6,237,272 | B1 * | 5/2001 | Scott | 42/70.11 |
| 6,299,664 | B1 | 10/2001 | Matsumoto et al. | |
| 6,564,689 | B1 | 5/2003 | Billgren | |
| 6,682,582 | B1 * | 1/2004 | Speidel | 75/252 |
| 2002/0168282 | A1 * | 11/2002 | Lu et al. | 419/54 |
| 2004/0216350 | A1 * | 11/2004 | Huston | 42/76.1 |
| 2005/0016639 | A1 | 1/2005 | Weldle et al. | |
| 2005/0235546 | A1 * | 10/2005 | Wonisch et al. | 42/75.01 |

FOREIGN PATENT DOCUMENTS

| | | | |
|---|---|---|---|
| DE | 19805598 | A1 | 8/1999 |
| DE | 10151358 | A1 | 4/2003 |
| EP | 0 404 159 | A1 | 12/1990 |
| EP | 1 486 750 | A1 | 12/2004 |
| EP | 1183121 | B1 | 3/2005 |

* cited by examiner

*Primary Examiner*—Roy King
*Assistant Examiner*—Ngoclan T Mai
(74) *Attorney, Agent, or Firm*—Laurence A. Greenberg; Werner H. Stemer; Ralph E. Locher

(57) ABSTRACT

A method for producing a breech slide of a firearm in a metal injection molding process. The process includes the following steps: a green body is injected in an injection mold. The green body is cooled. The binder is removed from the green body to form a brown body. Then the brown body is sintered.

7 Claims, 2 Drawing Sheets

PROCESS FOR PRODUCING A BREECH SLIDE FOR A FIREARM

BACKROUND OF THE INVENTION

Field of the Invention

The present invention relates to processes for producing a breech slide of a firearm.

The breech is subject to the highest demands of all the components of a weapon. In addition to the breech slide comprising the actual breech block, the assembly also includes the striker, which ignites the cartridge, and various catch systems. Lateral guide slots in the breech slide allow a forward and backward movement or an opening and closing of the breech. The opening can be effected either manually by the force of a hand or semi-automatically by means of the ignited cartridge. The latter is typical of the self-loading principle. The ignited cartridge uses the gas discharge which takes place to open the breech, and the cartridge case is drawn out of the chamber with the aid of an extractor lever and catapulted out through the ejector window. The closure slide, which rebounds through spring force, i.e. closes again, as it does so carries with it the next cartridge from the magazine and feeds it to the chamber in the assembly.

Therefore, the breech slide has to be able to cope with the sudden forces caused by the ignition of the cartridge. This primarily demands tensile strength, toughness, hardness and a certain impact resistance.

The thermal stresses are also very high for fast round changes. The region which is subject to the highest stresses is referred to as the base, which is where the case is supported during ignition.

Conventional materials for breech slides are cold-work steels, such as for example an X19NiCrMo4, which is first of all heat treated and then machined with the removal of material. This sequence is imposed by the complex geometry and the tight tolerances. Distortions caused by the heat treatment cannot generally be compensated for.

The problem on which the present invention is based is that of providing a process of the type described in the introduction which allows inexpensive production of a breech slide.

SUMMARY OF THE INVENTION

According to the invention, this is achieved by a process of the type described in the introduction having the defining features of claim 1. The sub claims relate to preferred configurations of the invention.

According to claim 1, it is provided that the breech slide is produced by a metal injection molding process comprising the following process steps:

- injecting a green body in an injection mold;
- cooling the green body;
- removing the binder from the green body to form a brown body;
- sintering the brown body.

A breech slide can be produced at low cost by means of a metal injection molding process. The text which follows is to provide a brief summary of the metal injection molding process (MIM process) itself, which is known for the production of other parts:

Metal injection molding is essentially a series of established manufacturing processes. The individual processes involved are:

- production of metal powder;
- production of binder;
- mixing of metal powder and binder;

- combining the two components to form the feedstock;
- shaping by injection molding;
- removing the binder;
- sintering.

Very fine powders form the basis of the starting material. They generally comprise spherical particles, in order to offer the minimum possible resistance during the subsequent flow process inside the mold. The particle size is usually less than 45 μm, but this does vary according to the type of powder used. Chemical processes or atomization using inert gases are used to actually produce the powder. Analogously to other powder metallurgy processes, the starting material used in the production of powders for the metal injection molding process may be pure, alloyed or mixed powders. This opens up the possibility of using a relatively wide range of materials, the properties of which in most cases are very different. The use of mixed powders comprising a ceramic fraction or with added fiber materials is also conceivable.

The second component of the starting material is the organic binder. The structure of the binder results from the various and in some cases contradictory requirements, such as for example:

- good wetting properties;
- good flow properties in conjunction with the powder;
- the ability to allow thermal shrinkage during the injection molding process;
- a high dimensional stability during handling of the green body;
- ease of removal from the green body without allowing relative movements on the part of the powder particles;
- removal as far as possible without leaving any residue prior to the sintering process;
- ecological compatibility.

These demands have led to various formulations becoming commercially available. However, none of them satisfies all the requirements 100%. The appropriate binder is selected according to the demands imposed on the subsequent component. However, a binder is usually composed of at least three components, each having its own role:

Component 1 acts as an adhesion promoter between organic fraction and metallic fraction. This is achieved by surface wetting of the powder particles.

Component 2 is intended to ensure the ability of the entire mixture to flow during the injection molding process. Therefore, its objective is to ensure that the resistance to the flow movement is minimized.

By contrast, component 3 provides sufficient strength of the green body and therefore ensures the dimensional stability of the shaped body. This component is generally only removed during the sintering process and not, like the other two components, as early as during the removal of binder from the shaped body.

The following process step is the mixing of the powder with the organic binder. The objective of this step is to achieve homogeneous mixing of all the constituents, in order also to have homogenous properties in the subsequent component. This is particularly important in the binder removal process and the subsequent sintering, since it is in this way possible to achieve uniform shrinkage over the entire component. The mixing ratio of powder and binder is generally in the vicinity of a ratio of 60% by volume to 40% by volume. The objective is to fill the spaces between the powder particles without increasing the distance between them. The binder wets the surface of the powder particles and destroys agglomerates which are present and are formed by the use of very fine powders. The entire process takes place at temperatures above the melting point of the binder and is generally carried out in mixers, kneaders or extruders. The homogeneous material formed is referred to as the feedstock. The latter is finely processed further to form free-flowing granules, which simplifies transport and storage. The granules also offer the possibility of being used in commercially available injection molding machines.

It is possible to purchase finished feedstock products, such as for example those sold by BASF marketed under the CATAMOLD tradename.

The shaping of the feedstock in metal injection molding is carried out by an injection molding process. Commercially available injection molding machines are used, if appropriate equipped with wear-resistant cylinder units. The process therefore takes place similarly to the injection-molding of plastics. The screw and external temperature control are responsible for plasticizing the feedstock. Standard pressures for introduction into the mold are between 500 and 2000 bar. The feedstock is supplied via a gate and if appropriate runners connected to it. Once the material in the temperature-controlled mold has solidified, a shrinkage process in the range of less than 1% takes place, as in the case of plastics. The component can be forced out of the cavity and removed by means of ejector pins. The result is the green body, which is very susceptible to distortion and until final cooling can be deformed by even minor forces. Therefore, at this point careful handling is the primary requirement. When it is removed from the injection mold, the green body usually has a gate rod, which corresponds to the gate, and one or more gate channels on removal from the mold. With regard to the component design, anything is feasible, as is also the case with plastic injection moldings. Therefore, complex geometries can be produced by using slides and by virtue of the multi-part structure of the mold. If the mold design allows, it is even possible to produce undercuts, transverse bores or finished screw threads.

The next working step is the removal of the binder. This process, known as debinding, involves removing the organic fraction, i.e. the binder, from the green body. Various processes have been used for this purpose, generally depending on the binder employed in each instance. A distinction can be drawn between three basic principles:

In the case of thermal removal of the binder, the individual organic substances are evaporated out of the green body by defined heating.

By contrast, solvent binder removal uses a solvent, for example acetone, which dissolves the organic fractions out of the green body. An insoluble binder component continues to ensure that the structure is held together and evaporates out during the subsequent sintering process.

Catalytic binder removal operates similarly to solvent binder removal, except that the organic components are not dissolved, but rather are catalytically decomposed into fractions which are easy to evaporate. These fractions then evaporate in the subsequent sintering process.

Irrespective of the process used, the intermediate product obtained after the removal of binder is an extremely porous shaped body which is only held together by a residual binder fraction amounting to about 10% of the original quantity. These shaped bodies are also known as brown bodies. The residual binder finally completely evaporates during the subsequent sintering process. Modern continuous installations can combine the binder removal and sintering, leading to a smooth transition between the two processes.

The sintering process, together with the feedstock production, is the most know-how intensive operation of the entire metal injection molding process. In the sintering process, the brown body is compacted at temperatures below the melting point of the alloy used, to form a compact body. This therefore involves a heat treatment with a solid phase. Any residual binder fractions which are present are also evaporated in this process. The heat treatment is carried out in special high-temperature furnaces under a shielding gas atmosphere or in a vacuum. The shrinkage process which takes place is dependent on the composition of the feedstock used and is generally between 10% and 20%, based on the starting dimensions of the green body or brown body. The result is a component with a final density above 96% of the theoretical density. This ensures a gastight and liquid-tight material, which with comparable pure powder metallurgy production processes cannot be achieved or can only be achieved with a very high level of rework. Any residual pores which are present are finely distributed and in closed form as porosity included in the structure of the material. The greatest difficulty in this process step is that of ensuring the dimensional stability of the component at the high temperatures.

In the process according to the invention, it is possible to provide for the green body to be cooled slowly, in particular over a period of between 10 and 25 minutes. The slow cooling can prevent the formation of stresses in the green body, which could lead to cracks and distortions in the green body or subsequently to cracks and distortions in the breech slide during sintering.

In this context, it can in particular be provided that at least during part of the cooling operation different parts of the green body are at the same temperature or a temperature which only differs to such an extent that no cracks and/or distortions are formed in the green body during cooling. In particular the uniform cooling can contribute to the avoidance of cracks and distortions. This can be achieved, for example, by cooling the green body in a continuous furnace. Large quantities of green bodies can be cooled simultaneously in a continuous furnace, making the use of a continuous furnace of this type suitable for series production.

Alternatively, it is possible for the green body to be cooled in an oil bath or in contact with heated parts, in particular metal parts. A process of this type may quite easily be useful for small batch numbers.

When it is removed from the injection mold, the green body may have a sprue and at least one runner.

It is possible for the green body to be held by the sprue when the green body is being removed from the injection mold. It has been found that stresses may form in the green body if it is gripped at unsuitable points in order to be removed from the injection mold. Surprisingly, holding the green body by the sprue leads to no stresses or deformation or only very minor stresses or deformation of the green body.

It is possible to provide for the removal of binder to be carried out as a catalytic binder removal, in particular in a nitrogen atmosphere with the addition of nitric acid.

According to a preferred embodiment of the present invention, the sprue and/or the at least one runner remains on the breech slide that is to be produced until after the sintering of the brown body. In particular the at least one runner makes a significant contribution to stabilizing the green body or brown body, so that the risk of cracks or undesired deformations can be considerably reduced during sintering.

It is preferable for the sprue to be removed prior to the sintering of the brown body and to be pushed into a bore in the breech slide that is to be produced, in order to serve as a support in this bore during the sintering operation. On account of the fact that the sprue has been produced under the same conditions and from the same material as the remainder of the brown body, it has the same shrinkage properties during the sintering process, and can therefore be used to provide optimum support. At the same time, the sprue, as a typical waste part, can be put to good use.

It is possible for the material used for the injection molding of the green body to be 100Cr6 or 21NiCrMo2 (CATAMOLD 8620 from BASF) or 42CrMo. These materials are distinguished by the strength properties which can be achieved, and in particular by their elasticity and hardness.

Further features and advantages of the present invention will become clear from the following description of preferred exemplary embodiments with reference to the accompanying drawings, in which:

DESCRIPTON OF THE PREFERRED EMBODIMENTS

Figure 1:
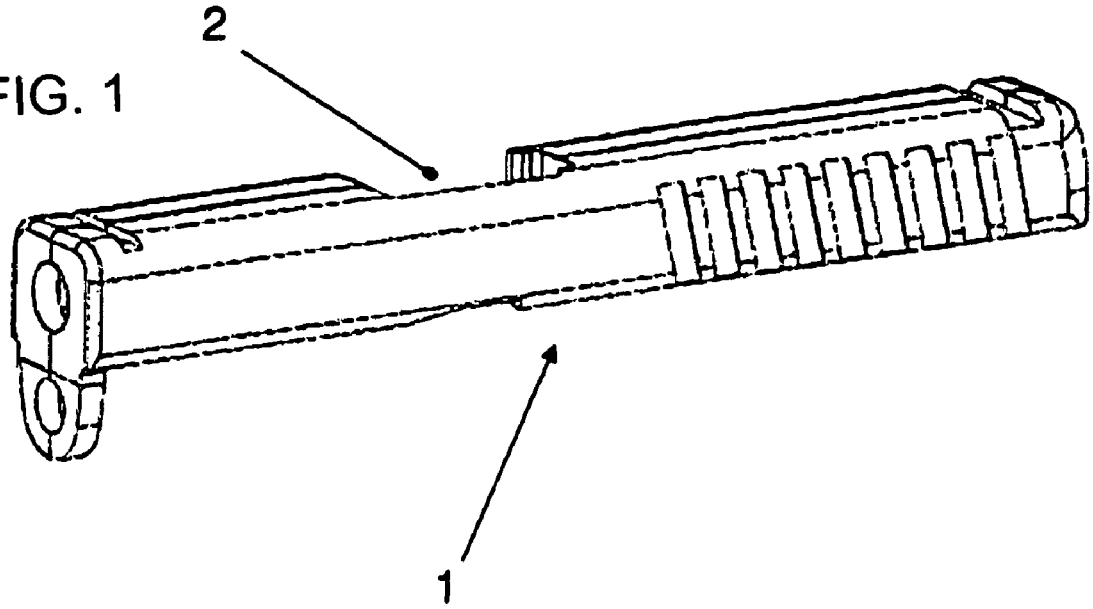
FIG. 1 shows a diagrammatic perspective view of a breech slide produced by a process according to the invention.

FIG. 1 shows a typical breech slide 1 which has been produced by a process according to the invention. In a central region, the breech slide 1 has an ejector window 2, through which, during the movement of the breech slide 1 caused by a round having been fired, the empty cartridge case is ejected.

The breech slide is denoted by different reference numerals 1, 3, 4 in FIG. 1 to FIG. 4, since the figures illustrate different stages of the production process. Reference numeral 1 denotes the fully sintered breech slide, reference numeral 2 denotes the green body after injection molding and reference numeral 3 denotes the brown body prior to sintering. The figures do not take account of the fact that the breech slide undergoes shrinkage during the transition from the green body to the brown body and to the sintered end product.

Figure 2:
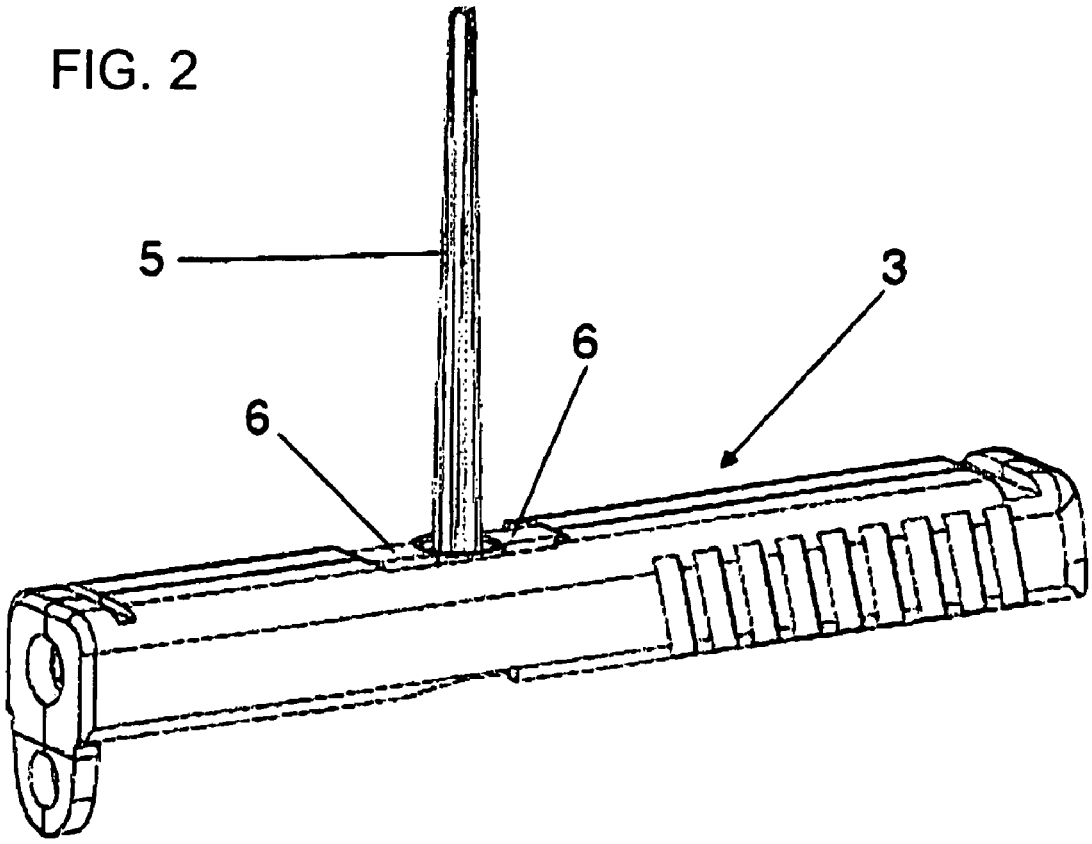
FIG. 2 shows a diagrammatic perspective view of the breech slide from FIG. 1 as a green body with sprue and two runners.
Figure 3:
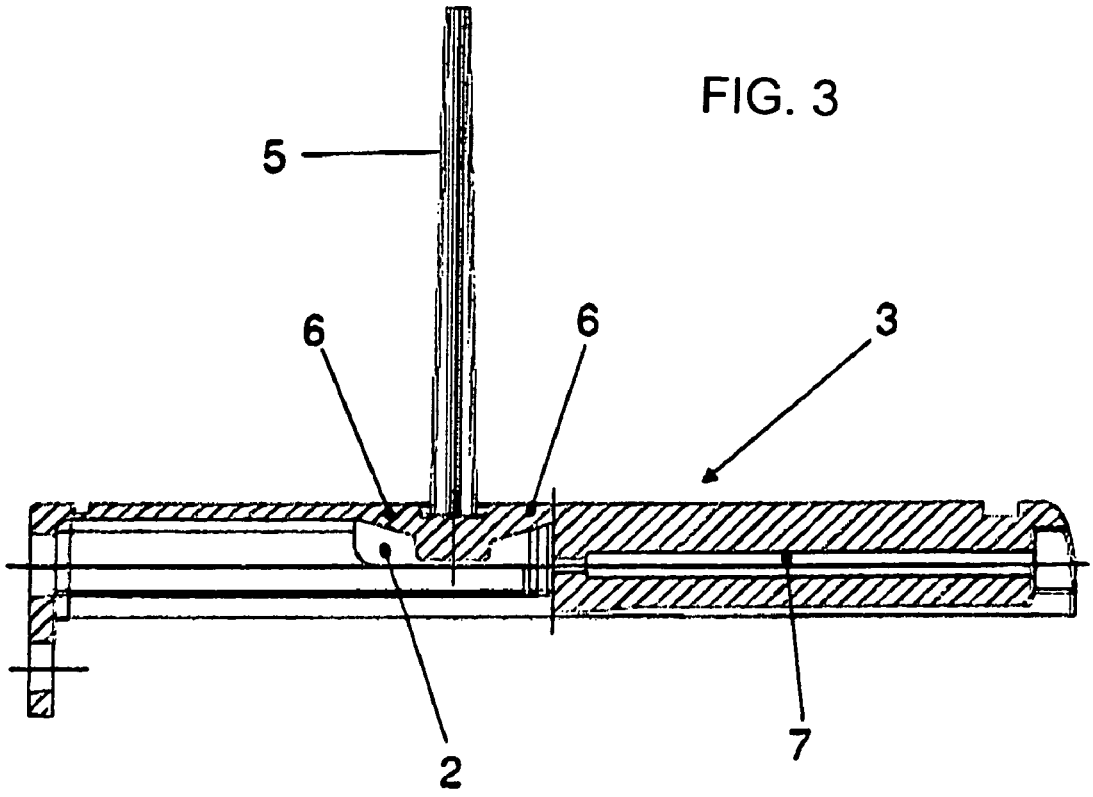
FIG. 3 shows a sectional view of the breech slide in the stage illustrated in FIG. 2.

In the exemplary embodiment illustrated, the starting material used for the injection molding of the green body 3 is 100Cr6. After the injection molding operation, the green body 3 is held by the sprue 5 (cf. in this respect (FIG. 2 and FIG. 3), and is removed from the injection mold (not shown). FIG. 2 and FIG. 3 show this green body 3 which has been removed from the injection mold. It can be seen from these figures that two runners 6 extend from the sprue 5 through the ejector window 2 in the longitudinal direction of the green body 3.

The green body 3 is cooled in a continuous furnace from approximately 100° C. to room temperature over the course of about 15 to 20 minutes. The continuous furnace ensures that all parts of the green body 3 are cooled at approximately the same rate.

After the cooling, the green body 3 is subject to catalytic binder removal by treatment with nitric acid in a nitrogen atmosphere to form a brown body 4. The sprue 5 can either be detached from the green body 3 immediately after injection molding, for example by being broken off, or can be detached from the green body 3 after cooling or alternatively may only be detached from the brown body 4 after the binder removal.

Figure 4:
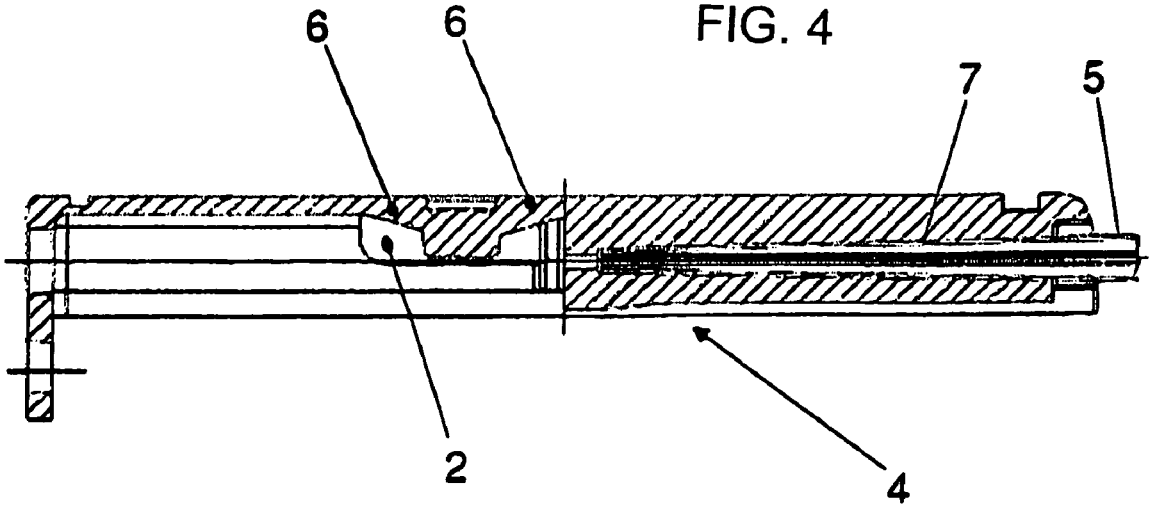
FIG. 4 shows a sectional view, corresponding to FIG. 3, of the breech slide as a brown body with a sprue which has been removed from the runners and introduced into a bore in the breech slide.

It can be seen from FIG. 3 and FIG. 4 that the breech slide 1 or the green body 3 and the brown body 4 have a bore 7 for receiving the striker of the firearm which is to be fitted with the breech slide 1. To enable the parts of the brown body 4 which surround this bore 7 to be supported during sintering, the sprue 5 which has been broken off is introduced into the bore 7.

The runners 6, which extend through the ejector window 2 in the longitudinal direction of the breech slide 1 or the brown body 4, are left in place on the brown body 4 during sintering in order to impart additional stability to it. After the sintering has ended, the runners 6 are removed, for example by being milled off, so as to open up the ejector window 2.

We claim:

1. A method of producing a breech slide of a firearm in a metal injection molding process, which comprises the following steps:
- injecting a green body in an injection mold;
- cooling the green body in a continuous furnace;
- removing binder from the green body to form a brown body; and
- sintering the brown body.

2. A method of producing a breech slide of a firearm in a metal injection molding process, which comprises the following steps:
- injecting a green body in an injection mold;
- cooling the green body in an oil bath or in contact with heated parts;
- removing binder from the green body to form a brown body; and
- sintering the brown body.

3. The method according to claim 2, which comprises cooling the green body in contact with heated metal parts.

4. A method of producing a breech slide of a firearm in a metal injection molding process, which comprises the following steps:
- injecting a green body in an injection mold and molding the green body such that, on removal from the injection mold, the green body has a sprue and at least one runner;
- cooling the green body;
- removing binder from the green body to form a brown body; and
- sintering the brown body.

5. The method according to claim 4, which comprises holding the green body by the sprue when the green body is being removed from the injection mold.

6. A method of producing a breech slide of a firearm in a metal injection molding process, which comprises the following steps:
- injecting a green body in an injection mold for molding a breech slide with a sprue and/or at least one runner;
- cooling the green body;
- removing binder from the green body to form a brown body;
- sintering the brown body; and
- retaining the sprue and/or the at least one runner on the breech slide until after the step of sintering the brown body.

7. A method of producing a breech slide of a firearm in a metal injection molding process, which comprises the following steps:
- injecting a green body in an injection mold and molding the green body with a sprue;
- cooling the green body;
- removing binder from the green body to form a brown body; and
- removing the sprue and pushing the sprue into a bore in the breech slide to be produced, in order to serve as a support in the bore during a following sintering step; and
- subsequently sintering the brown body.

* * * * *